US007013647B2

(12) United States Patent
Nishimura et al.

(10) Patent No.: US 7,013,647 B2
(45) Date of Patent: Mar. 21, 2006

(54) OUTER CASING COVERING GAS TURBINE COMBUSTOR

(75) Inventors: Masaharu Nishimura, Takasago (JP); Masaki Ono, Takasago (JP); Keizo Ohnishi, Takasago (JP); Katsunori Tanaka, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/023,702

(22) Filed: Dec. 21, 2001

(65) Prior Publication Data

US 2003/0115879 A1 Jun. 26, 2003

(51) Int. Cl.
*F02C 7/24* (2006.01)
*F01D 25/04* (2006.01)

(52) U.S. Cl. ..... 60/725; 60/752

(58) Field of Classification Search ..... 60/725, 60/752, 760; 431/114
See application file for complete search history.

(56) References Cited

U.S. PATENT DOCUMENTS

| | | | | |
|---|---|---|---|---|
| 2,930,195 | A * | 3/1960 | Blackman, Jr. et al. | 60/725 |
| 3,854,285 | A * | 12/1974 | Stenger et al. | 60/756 |
| 4,195,475 | A * | 4/1980 | Verdouw | 60/754 |
| 4,199,936 | A * | 4/1980 | Cowan et al. | 60/725 |
| 4,232,527 | A * | 11/1980 | Reider | 60/754 |
| 4,244,178 | A * | 1/1981 | Herman et al. | 60/754 |
| 4,411,616 | A * | 10/1983 | Neumann | 431/114 |
| 5,459,995 | A * | 10/1995 | Norton et al. | 60/796 |
| 6,351,947 | B1 * | 3/2002 | Keller et al. | 60/725 |
| 6,530,221 | B1 * | 3/2003 | Sattinger et al. | 60/725 |

FOREIGN PATENT DOCUMENTS

| | | |
|---|---|---|
| JP | 52-11923 | 3/1977 |
| JP | 60-139144 | 9/1985 |
| JP | 8-61659 | 3/1996 |
| JP | 11-062549 | 8/1997 |
| JP | 11-62549 | 3/1999 |
| JP | 2001-90939 | 4/2001 |

* cited by examiner

*Primary Examiner*—Ted Kim
(74) *Attorney, Agent, or Firm*—Oblon, Spivak, McClelland, Maier & Neustadt, P.C.

(57) ABSTRACT

A combustor structure of a gas turbine, in which a sheet-like vibration damper, which resonates with the air vibration in the intake chamber and absorbs the energy of the air vibration, is attached to the inner wall of the casing by an attaching member via a space.

The sheet-like vibration damper is made of a single-layered thin flat plate or multi-layered thin flat plates. In case of the multi-layered thin flat plate, the air vibration energy in the intake chamber is absorbed not only by resonance but also by friction among the multi-layered thin plates. The sheet-like vibration damper may be made of a three-dimensional profile member having an inner space in which the attaching member is housed. If the thin flat plates are used, the surface areas thereof are not identical. If the three-dimensional profile members are used, the volumes of the inner spaces are not identical. Consequently, the sheet-like vibration damper can absorb and attenuate the vibration energy of different frequencies. If holes to connect spaces on opposite sides of the sheet-like vibration damper are formed in the sheet-like vibration damper, the air circulates between the spaces on opposite sides of the sheet-like vibration damper. Thus, the sheet-like vibration damper easily vibrates.

13 Claims, 5 Drawing Sheets

OUTER CASING COVERING GAS TURBINE COMBUSTOR

BACKGROUND OF THE INVENTION

1. Field of the Invention

The present invention relates to combustor and, especially, a gas turbine combustor.

2. Description of the Related Art

A combustor has been used in various fields. The need for combustion at a high air-fuel ratio, i.e., a lean-burn combustion has increased as the exhaust emission, especially, the exhaust emission of $NO_x$ has become strictly regulated. A fluctuation in combustion tends to occur as lean-burn combustion takes place, this resulting in a fluctuation in the pressure of a combustion gas.

For example, as shown in FIG. 10, in a gas turbine, a casing 100 covers, but is separate from, a plurality of combustors 200 in which combustion takes place. An intake chamber 300 is formed between the combustors and the casing. The air discharged from a compressor is introduced into the intake chamber 300, and into the inside of the combustors 200, and is mixed with fuel supplied from fuel nozzles 400 to burn. Thus, the combustion gas is introduced into a turbine portion.

The intake chamber 300 is generally annular, and is very large, i.e., the length thereof in the axial direction is often more than 2 m and the width thereof in the radial direction of the annulus is often more than 1 m. This large intake chamber forms a sound field and, accordingly, if the pressure in the combustors 200 varies due to the combustion fluctuation, the pressure variation is transmitted to the intake chamber 300, so that a frequency component corresponding to a natural frequency of the sound field is amplified and re-propagated to the combustors 200. Accordingly, the pressure variation in the combustors 200 is further increased. Consequently, a so-called combustion vibration phenomenon occurs, in which the amount of fuel or air introduced into the combustors varies and the burning fluctuation is further enhanced.

Japanese Unexamined Patent Publication (Kokai) No. 11-62549 discloses an acoustic material, or sound absorbing material, attached to the inner wall of the casing 100 to restrict the air-vibration-amplifying operation in the intake chamber 300.

However, the intake chamber 300 is subject to severe conditions, i.e., 500° C. in temperature and 2.5 MPA in pressure, and is positioned on the upstream side of a turbine chamber which rotates at high speed. It is required that the acoustic material cannot be broken or scattered even under the above severe conditions. In fact, it is very difficult to obtain an acoustic material which meets the above requirements at a reasonable cost.

SUMMARY OF THE INVENTION

In view of the above problems, the object of the present invention is to provide a combustor structure of a gas turbine in which the air vibration in an intake chamber is reliably restricted at low cost.

The present invention provide a combustor of a gas turbine in which a combustor covered by a casing via an intake chamber, characterized in that a sheet-like vibration damper which resonates with the vibration of air in the intake chamber to absorb the energy of the air vibration is attached to an inner wall of the casing by an attaching member with a space therebetween.

In the combustor constructed as described above, the energy of air vibration in the intake chamber is absorbed by the sheet-like vibration damper which resonates with the air vibration in the space.

The sheet-like vibration damper is made of a single-layered thin flat plate or a multi-layered thin flat plate. In case of the multi-layered thin flat plate, the air vibration energy in the intake chamber is absorbed not only by resonance but also by friction among the multi-layered thin flat plates. If thin flat plates of different sizes are used, the air vibration energy of different frequencies can be absorbed and attenuated.

In an embodiment of the present invention, the attaching member is a stud which is composed of a bolt welded to the inner wall of the casing and two nuts which hold the thin plate therebetween, said nuts being engaged with the bolt and being thereafter welded thereto.

In another embodiment, the sheet-like vibration damper is made of a three-dimensional profile member which is shaped to define an inner space in which the attaching member is contained. The three-dimensional profile member resonates with the air vibration to absorb the air vibration energy in the intake chamber.

Moreover, the three-dimensional profile member may be a single three-dimensional profile member having therein a single independent inner space, and a plurality of single three-dimensional profile members are attached to the inner wall of the casing. In this case, the single three-dimensional profile member may be a box-like three-dimensional profile member having therein a closed space.

Moreover, the three-dimensional profile member may be a continuous three-dimensional profile member having therein a plurality of independent spaces.

Moreover, if the inner spaces of the three-dimensional profile member have different volumes, three-dimensional profile members of different sizes can absorb and attenuate the energy of air vibrations of different frequencies.

In yet another embodiment, the sheet-like vibration damper is provided with holes to connect spaces on opposite sides thereof. In the combustor structure constructed as described above, the air circulates between the spaces on opposite sides of the sheet-like vibration damper. Thus, the sheet-like vibration damper easily vibrates.

The present invention may be more fully understood from the description of preferred embodiments of the invention set forth below, together with the accompanying drawings.

DESCRIPTION OF THE PREFERRED EMBODIMENTS

Figure 10:
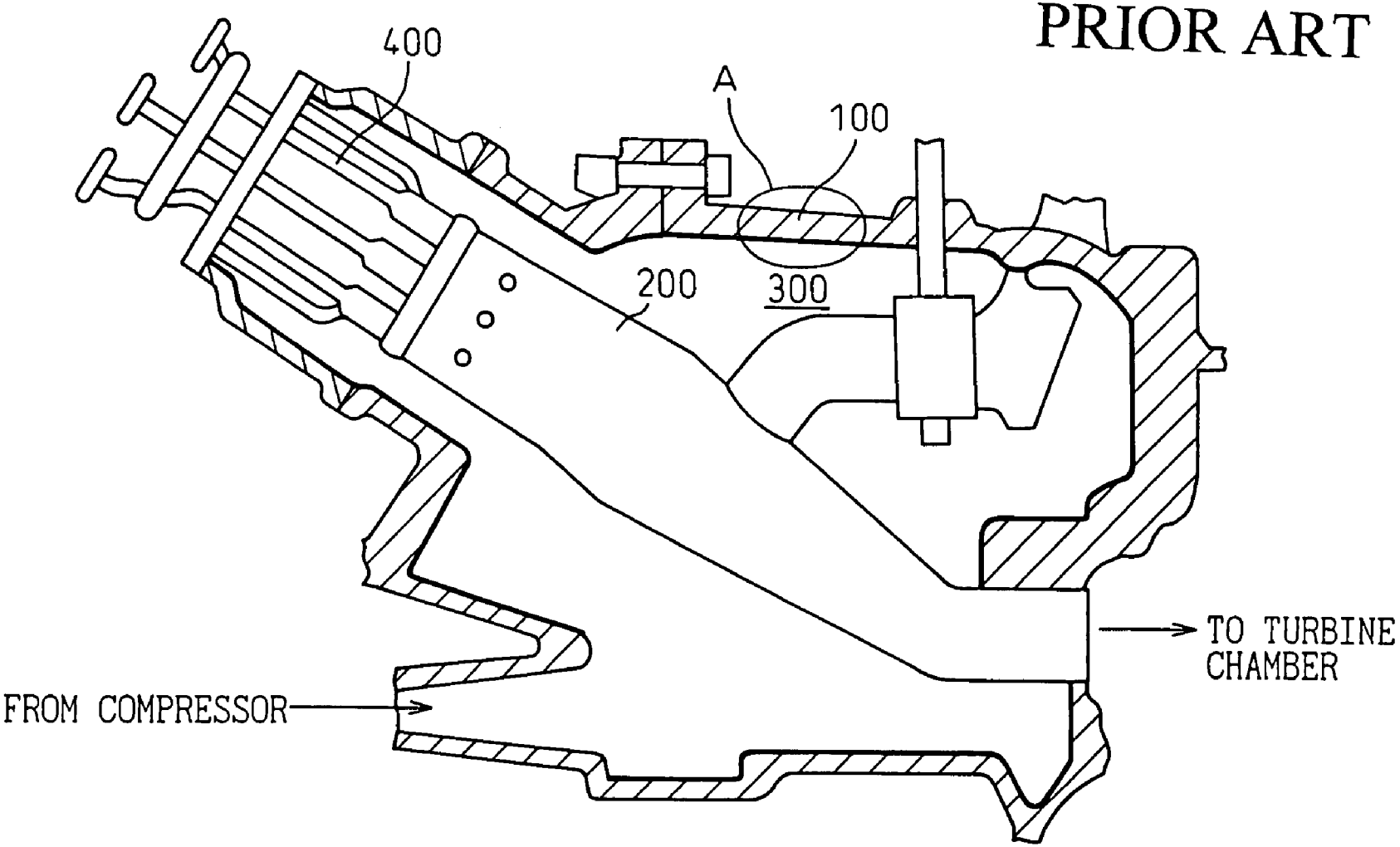
Fig.10 PRIOR ART
FIG. 10 generally shows the entirety of a combustor structure of a gas turbine.

A sheet-like vibration damper and a method for attaching the same in each embodiment of a combustor structure according to the present invention will be described below with reference to FIG. 1 to FIG. 9. In each drawing, although the present invention is applied to a portion represented by "A" in FIG. 10 by way of example, the present invention can be applied to not only this portion but also all the portions indicated by a thick solid line in FIG. 10.

Figure 1:
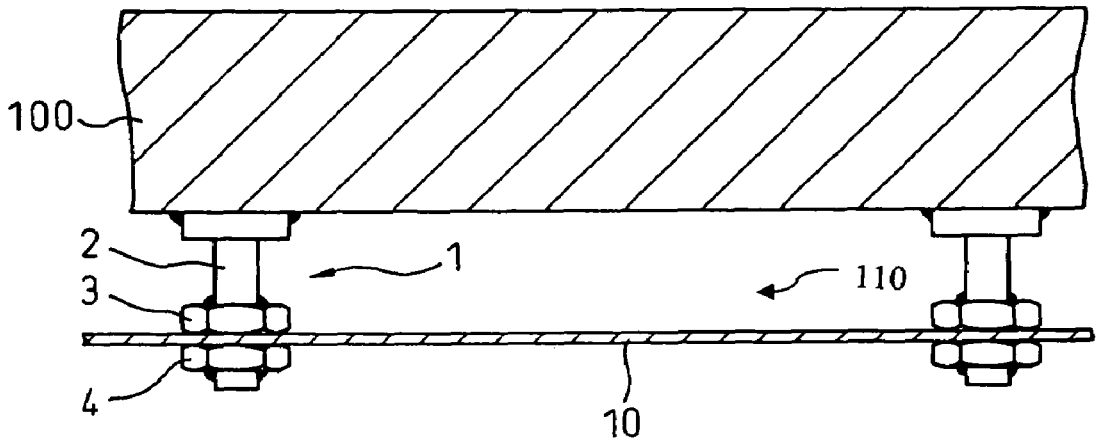
FIG. 1 is a view showing the features of a first embodiment of the present invention.

FIG. 1 is a view in which a sheet-like vibration damper of a first embodiment and a method for applying the same are shown. With reference to FIG. 1, a single thin flat plate 10, as a sheet-like vibration damper, is attached to the inside of the casing 100 via studs 1. The casing 100 practically has a thickness of move than 10 cm. Contrary to this, the thin flat plate 10 has a thickness slightly smaller than 1 mm. For clarity, the thin flat plate 10 and the studs 1 are exaggerated in FIG. 1 (and in FIGS. 2 to 9).

A method for mounting the thin flat plate 10 by the studs 1 will now be described. For each stud, a bolt 2 is welded to the casing 100. A nut 3 is screw-engaged with the bolt 2 and is positioned in a predetermined position and, thereafter, the outer nut 3 is welded to the bolt 2. In this state, the bolt 2 passes through a mounting hole (not shown) formed, in advance, in the thin flat plate 10, so that the thin flat plate 10 is engaged with the bolt 2. After that, an inner nut 4 is screw-engaged with the bolt 2 and is fastened. Thereafter, the inner nut 4 is welded to the bolt 2. As a result, no disengagement of the nut or the bolt which would be otherwise moved to the turbine chamber on the downstream side, and could destroy a turbine blade or the like, occurs. The stud 1 represents an entire attaching element assembly composed of the bolt 2, the outer nut 3 and the inner nut 4.

The first embodiment is constructed as described above. The thin flat plate 10 is located inside the casing 100 via a space 110. Therefore, the vibration of air produced in the intake chamber 300 due to the pressure variation caused in the combustor 200 is absorbed by the thin flat plate 10 to attenuate the vibration. Thus, no increase in pressure variation occurs in the combustor 200, so that a vicious circle, i.e., an increase in the instability of the combustion, can be broken. Consequently, a leaner-burn combustion can be carried out, thus resulting in a reduction of $NO_x$.

Two or more thin flat plates 10 are used as the entirety of the inside of the casing 100 cannot be covered by a single flat plate 10. In this case, thin flat plates 10 which are identical in size are not used, and thin flat plates of different sizes are used. If the size is different, flat plates can absorb and attenuate different frequencies. Therefore, the different-sized thin flat plates can absorb and attenuate vibrations of various frequencies. The vibration frequency to be absorbed and attenuated is low, i.e., several tens to hundreds of Hz.

Figure 2:
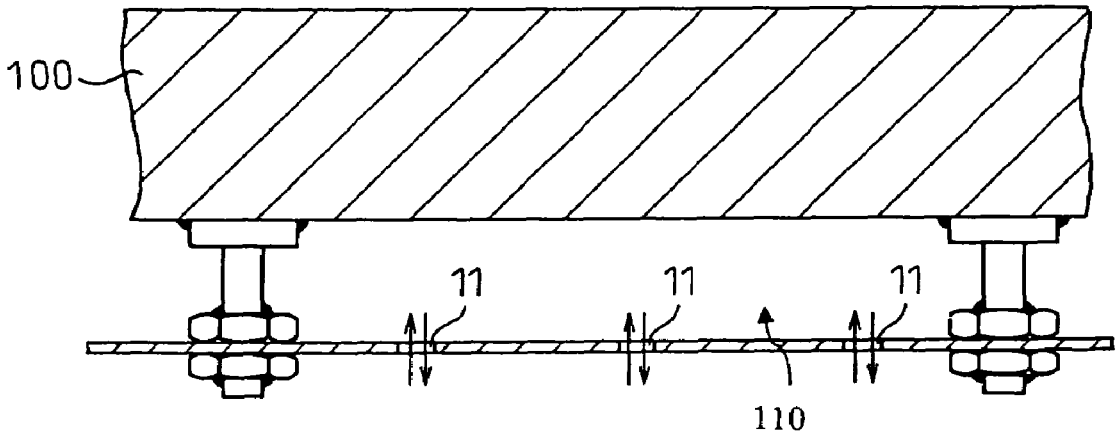
FIG. 2 is a view showing the features of a second embodiment of the present invention.

A second embodiment, as shown in FIG. 2, will be described below. In the second embodiment, the thin flat plate 10 is a perforated plate having holes 11. The effect same as that of the first embodiment can be obtained in the second embodiment. The holes of the perforated plate enable the air in the space 110 to flow into the inside space. Accordingly, the thin flat plate 10 can be easily vibrated. Thus, the attenuation property can be improved, and the attenuation characteristics can be modified.

Figure 3:
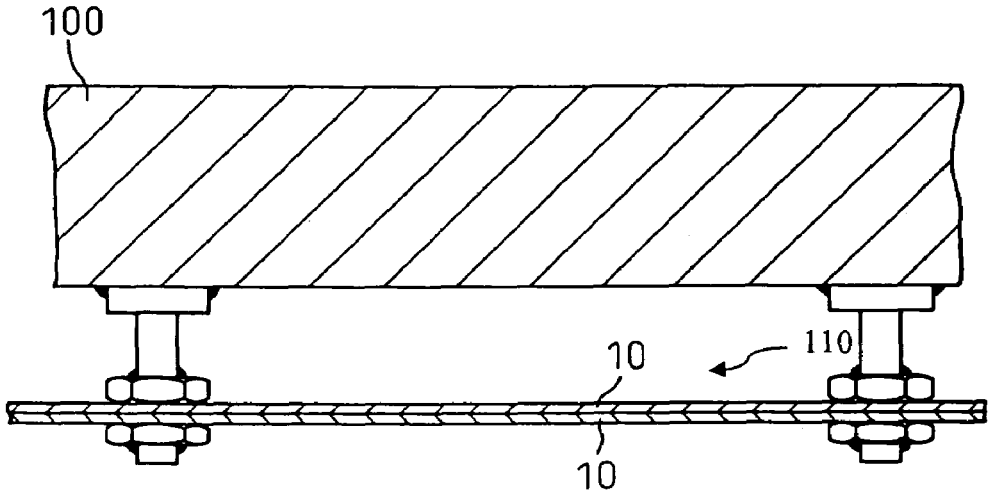
FIG. 3 is a view showing the features of a third embodiment of the present invention.

A third embodiment shown in FIG. 3 is described below. In the third embodiment, a plurality of thin flat plates 10 are superimposed. The same effect as that of the second embodiment can be obtained in the third embodiment. A friction occurs between the multi-layered thin flat plates when the thin flat plates vibrate. Therefore, there is an advantage that the attenuation effect can be enhanced by the friction.

Figure 4:
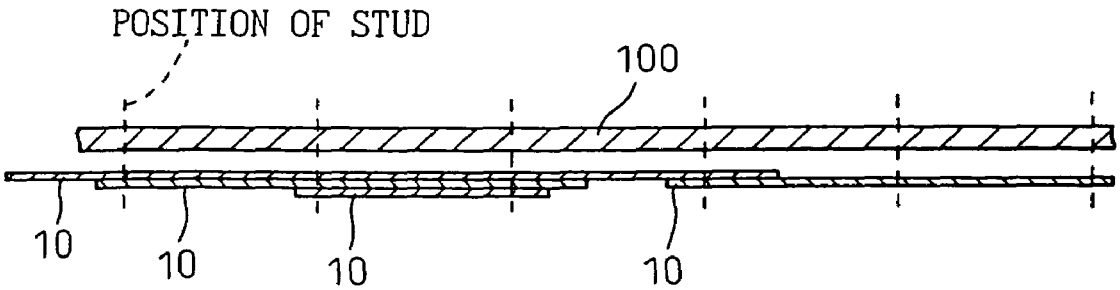
FIG. 4 is a view showing the features of a fourth embodiment of the present invention.

A fourth embodiment shown in FIG. 4 is described below. In the fourth embodiment, plural thin flat plates 10 are superimposed. As in the third embodiment, in the forth embodiment, the plural thin flat plates 10 are multi-layered. However, in this embodiment, the size of the plates or the number of the layers is different. Thus, an advantage, that vibrations of various frequencies can be absorbed and attenuated, in addition to the effect expected from the third embodiment, can be obtained.

The perforated plate in the second embodiment may be used in the third or fourth embodiment. In place of the perforated plate, portions in which the thin flat plate is absent may be appropriately provided.

Figure 5:
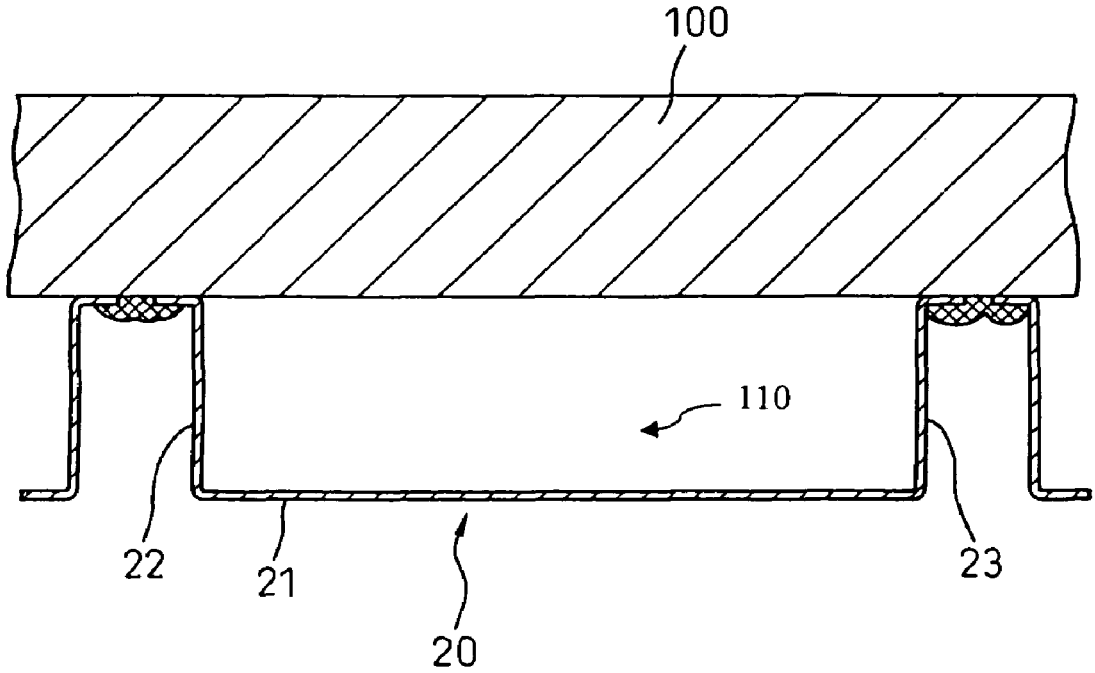
FIG. 5 is a view showing the features of a fifth embodiment of the present invention.

A fifth embodiment shown in FIG. 5 will be described below. In the fifth embodiment, the thin flat plate in the first to fourth embodiment is replaced with a three-dimensional profile member 20 of a thin plate, attached to the casing 100. The profile member 20 has planar portions 21 and side face portions 22. The end portions of the side face portions 22 can be directly welded to the casing. Therefore, the studs 1 used in the first to fourth embodiments can be dispensed with.

The fifth embodiment is constructed as described above. The profile member 20 and, especially, the flat face portions 21, absorb the vibration of air in the intake chamber 300. Accordingly, a basic effect the same as that of the first embodiment can be obtained.

Figure 6:
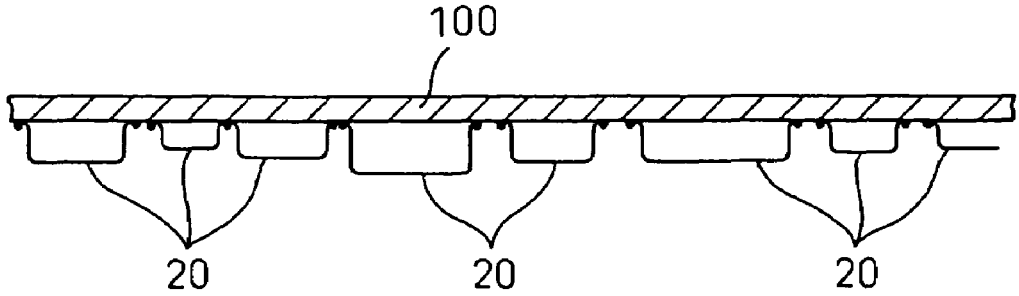
FIG. 6 is a view showing the features of a sixth embodiment of the present invention.

In a sixth embodiment shown in FIG. 6, three-dimensional profile members 20 of different sizes are attached to the casing 100. Accordingly, the sixth embodiment has an advantage in that it is adaptable for vibrations of various frequencies, in addition to the effect of the fifth embodiment.

Figure 7:
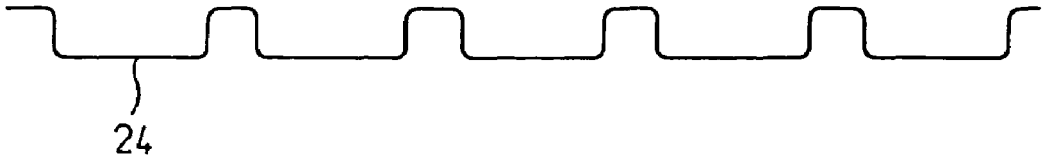
FIG. 7 is a view of a continuous three-dimensional profile member used in the seventh embodiment.

In FIG. 7, a three-dimensional profile member 24 of a seventh embodiment is shown. Each three-dimensional profile member 20 in the sixth embodiment contains one independent space, whereas, the continuous three-dimensional profile member 24 in the seventh embodiment contains a plurality of spaces. Therefore, the attaching operation of the member 24 can be facilitated.

Figure 8:
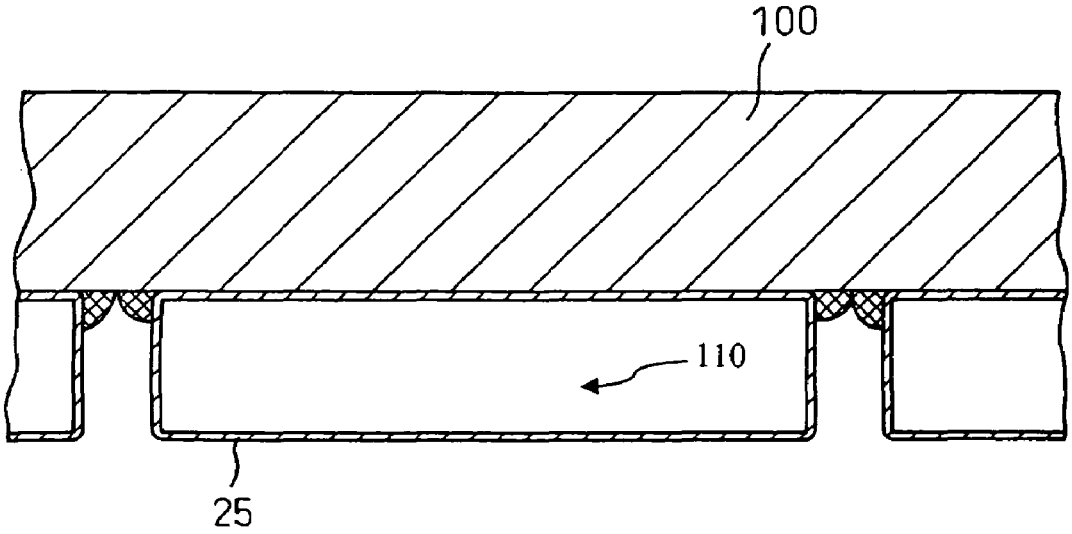
FIG. 8 is a view showing the features of an eighth embodiment of the present invention.
Figure 9:
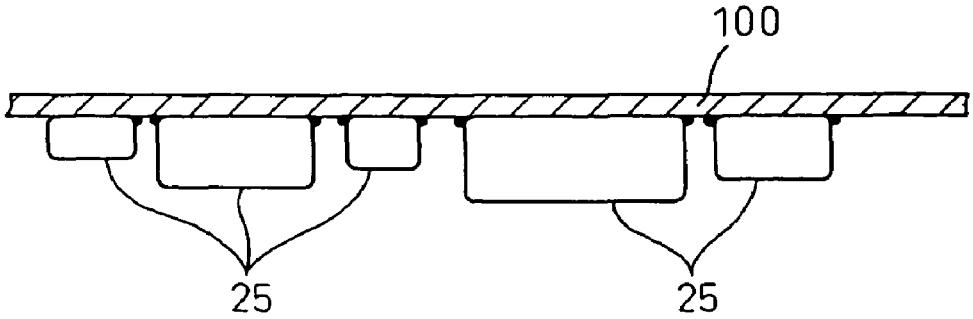
FIG. 9 is a view showing the features of a ninth embodiment of the present invention.

An eighth embodiment is shown in FIG. 8. A three-dimensional profile member 25 in the eighth embodiment is a box-like profile member which defines therein a closed space, and is stronger than the three-dimensional profile member 20 in the fifth or sixth embodiment.

In a ninth embodiment, box-like three-dimensional profile members 25 of different sizes are attached to the casing 100. Accordingly, in addition to the effect of the eighth embodiment, the ninth embodiment has an advantage that it is adaptable for vibrations of various frequencies.

It is possible to provide holes in each three-dimensional profile member in the fifth to eighth embodiments, as described in connection with the second embodiment or to make the three-dimensional profile member of a perforated plate.

The present invention relates to a combustor structure of a gas turbine and the above explanation has been given for the gas turbine. However, the present invention can be applied to a combustor structure similar to that of the gas turbine. The shape of the sheet-like vibration damper and the method for attaching the same can be modified within the spirit of the present invention. The present invention includes those modifications.

According to the present invention, in a gas turbine combustor covered by a casing via a large space, a sheet-like vibration damper which absorbs the air vibration in a space by changing the air vibration to the vibration of the damper is disposed at a distance from the inner wall of the casing, and the air vibration in the space is absorbed and attenuated by the sheet-like vibration damper. Therefore, a vicious circle, i.e., an increase in the vibration in the combustor and an increase in the instability of combustion, can be broken. Consequently, a leaner-burn combustion can be carried out, and this contributes to a reduction in $NO_x$ output. In addition, the structure thereof is simple, thus resulting in high durability and low cost.

While the invention has been described by reference to specific embodiments chosen for purpose of illustration, it should be apparent that numerous modifications could be made thereto by those skilled in the art without departing from the basic concept and scope of the invention.

The invention claimed is:

1. A gas turbine combustor, comprising:

a casing configured to surround a combustor and to be disposed apart from the combustor to define an intake chamber between the combustor and the casing; and a sheet-like vibration damper having at least one thin plate, which resonates with a vibration of air in the intake chamber to absorb energy of the air vibration, is attached to an inner wall of the casing by an attaching member with a vacant space therebetween, the damper comprising a plurality of steps.

2. The gas turbine combustor according to claim 1, wherein the damper comprises a plurality of thicknesses including at least three thicknesses in a direction perpendicular to a direction of air flow through the intake chamber.

3. A gas turbine combustor covered by a casing via an intake chamber, comprising:

a sheet-like vibration damper, which resonates with a vibration of air in the intake chamber to absorb energy of the air vibration, is attached to an inner wall of the casing by an attaching member with a space therebetween, wherein the sheet-like vibration damper comprises a multi-layered thin flat plate, the layers staggered to create the damper of variable thickness.

4. The gas turbine combustor according to claim 1 or 3, wherein the damper comprises a plurality of plates of at least two different sizes.

5. A gas turbine combustor covered by a casing via an intake chamber, comprising:

a sheet-like vibration damper, which resonates with the vibration of air in the intake chamber to absorb the energy of the air vibration, is attached to an inner wall of the casing by an attaching member with a space therebetween, wherein the attaching member is a stud which is composed of a bolt welded to the inner wall of the casing and two nuts which hold the thin plate therebetween, said nuts being engaged with the bolt and being thereafter welded thereto.

6. A gas turbine combustor, comprising:

a casing surrounding an intake chamber, the casing configured to surround a combustor and to be disposed apart from the combustor and the intake chamber; and a damper connected to an inner wall of the casing and configured to resonate with a vibration of air in the intake chamber, the damper having a plurality of thicknesses in a direction perpendicular to a direction of air flow through the intake chamber, the damper comprising a plurality of steps providing the plurality of thicknesses.

7. The gas turbine combustor according to claim 6, wherein the damper comprises a plurality of plates.

8. The gas turbine combustor according to claim 6, wherein the damper comprises a plurality of plates at least partially overlapped with one another.

9. The gas turbine combustor according to claim 6, wherein the plurality of thicknesses comprises at least three thicknesses in the direction perpendicular to the direction of air flow through the intake chamber.

10. A gas turbine combustor, comprising:

a casing configured to surround a combustor and to be disposed apart from the combustor to define an intake chamber between the combustor and the casing; and a sheet-like vibration damper having at least one thin plate, which resonates with a vibration of air in the intake chamber to absorb energy of the air vibration, is attached to an inner wall of the casing by an attaching member with a vacant space therebetween, wherein the damper comprises a plurality of thicknesses including at least three thicknesses in a direction perpendicular to a direction of air flow through the intake chamber, and wherein the damper comprises a plurality of stepped portions providing the plurality of thicknesses.

11. The gas turbine combustor according to claim 10, wherein a plurality of fasteners are disposed through the plurality of thicknesses.

12. A gas turbine combustor, comprising:

a casing surrounding an intake chamber, the casing configured to surround a combustor and to be disposed apart from the combustor and the intake chamber; and a damper connected to an inner wall of the casing and configured to resonate with a vibration of air in the intake chamber, the damper having a plurality of thicknesses in a direction perpendicular to a direction of air flow through the intake chamber, wherein the plurality of thicknesses comprises at least three thicknesses in the direction perpendicular to the direction of air flow through the intake chamber, and wherein the damper comprises a plurality of stepped portions providing the plurality of thicknesses.

13. The gas turbine combustor according to claim 12, wherein a plurality of fasteners are disposed through the plurality of thicknesses.

* * * * *